US008626517B2

(12) United States Patent
Bessette

(10) Patent No.: US 8,626,517 B2
(45) Date of Patent: Jan. 7, 2014

(54) SIMULTANEOUS TIME-DOMAIN AND FREQUENCY-DOMAIN NOISE SHAPING FOR TDAC TRANSFORMS

(75) Inventor: Bruno Bessette, Sherbrooke (CA)

(73) Assignee: Voiceage Corporation, Town of Mount Royal, Quebec (CA)

( * ) Notice: Subject to any disclaimer, the term of this patent is extended or adjusted under 35 U.S.C. 154(b) by 138 days.

(21) Appl. No.: 12/905,750

(22) Filed: Oct. 15, 2010

(65) Prior Publication Data

US 2011/0145003 A1 Jun. 16, 2011

Related U.S. Application Data

(60) Provisional application No. 61/272,644, filed on Oct. 15, 2009.

(51) Int. Cl.
*G10L 19/08* (2013.01)
*G10L 19/12* (2013.01)

(52) U.S. Cl.
USPC ..... 704/500; 704/219

(58) Field of Classification Search
USPC ..... 704/500
See application file for complete search history.

(56) References Cited

U.S. PATENT DOCUMENTS

| | | | | |
|---|---|---|---|---|
| 5,781,888 | A * | 7/1998 | Herre | 704/200.1 |
| 6,363,338 | B1 * | 3/2002 | Ubale et al. | 704/200.1 |
| 7,062,040 | B2 * | 6/2006 | Faller | 379/406.11 |
| 7,395,211 | B2 * | 7/2008 | Watson et al. | 704/500 |
| 7,921,009 | B2 * | 4/2011 | Dai | 704/223 |
| 8,036,903 | B2 * | 10/2011 | Grill et al. | 704/500 |
| 8,046,216 | B2 * | 10/2011 | Dai | 704/223 |
| 2004/0158456 | A1 * | 8/2004 | Prakash et al. | 704/200.1 |
| 2005/0267742 | A1 * | 12/2005 | Makinen | 704/219 |
| 2007/0147518 | A1 * | 6/2007 | Bessette | 375/243 |
| 2007/0225971 | A1 * | 9/2007 | Bessette | 704/203 |
| 2007/0282603 | A1 * | 12/2007 | Bessette | 704/219 |
| 2008/0294446 | A1 * | 11/2008 | Guo et al. | 704/501 |

(Continued)

FOREIGN PATENT DOCUMENTS

CA 2556797 A1 8/2005

OTHER PUBLICATIONS

Ani'bal J. S, Ferreira, Convolutional Effect in Transform Coding with TDAC: An Optimal Window, Mar. 1996, IEEE vol. 4, No. 2, pp. 104-114.*

Princen et al., "Subband/Transform Coding Using Filter Bank Designs Based on Time Domain Aliasing Cancellation," IEEE International Conference on Speech, Acoustics and Signal Processing, 12:2161-2164, 1987.

(Continued)

*Primary Examiner* — David R Hudspeth
*Assistant Examiner* — Timothy Nguyen
(74) *Attorney, Agent, or Firm* — K&L Gates LLP

(57) ABSTRACT

A frequency-domain noise shaping method and device interpolates a spectral shape and a time-domain envelope of a quantization noise in a windowed and transform-coded audio signal. In the method and device, transform coefficients of the windowed and transform-coded audio signal are split into a plurality of spectral bands. For each spectral band, a first gain representing a spectral shape of the quantization noise at a first transition between a first time window and a second time window is calculated, a second gain representing a spectral shape of the quantization noise at a second transition between the second time window and a third time window is calculated, and the transform coefficients of the second time window are filtered based on the first and second gains, to interpolate between the first and second transitions the spectral shape and the time-domain envelope of the quantization noise.

38 Claims, 8 Drawing Sheets

(56) References Cited

U.S. PATENT DOCUMENTS

| | | | | |
|---|---|---|---|---|
| 2009/0281797 | A1* | 11/2009 | Zopf et al. | 704/207 |
| 2011/0057818 | A1* | 3/2011 | Jung et al. | 341/50 |
| 2011/0145003 | A1* | 6/2011 | Bessette | 704/500 |
| 2011/0320196 | A1* | 12/2011 | Choo et al. | 704/229 |
| 2012/0046955 | A1* | 2/2012 | Rajendran et al. | 704/500 |

OTHER PUBLICATIONS

ISO/IEC, "Information technology—MPEG audio technologies—Part 3: Unified speech and audio coding," ISO/IEC CD 23003-3, 164 pgs. 2010.

PCT International Search Report for International Patent Application No. PCT/CA2010/001649, mailed Jan. 13, 2011, 4 pgs.

* cited by examiner

SIMULTANEOUS TIME-DOMAIN AND FREQUENCY-DOMAIN NOISE SHAPING FOR TDAC TRANSFORMS

CROSS-REFERENCE TO RELATED APPLICATIONS

This application claims priority to and the benefit of U.S. provisional patent application No. 61/272,644, filed on Oct. 15, 2009, the entire contents of which are hereby incorporated by reference herein.

FIELD

The present disclosure relates to a frequency-domain noise shaping method and device for interpolating a spectral shape and a time-domain envelope of a quantization noise in a windowed and transform-coded audio signal.

BACKGROUND

Specialized transform coding produces important bit rate savings in representing digital signals such as audio. Transforms such as the Discrete Fourier Transform (DFT) and the Discrete Cosine Transform (DCT) provide a compact representation of the audio signal by condensing most of the signal energy in relatively few spectral coefficients, compared to the time-domain samples where the energy is distributed over all the samples. This energy compaction property of transforms may lead to efficient quantization, for example through adaptive bit allocation, and perceived distortion minimization, for example through the use of noise masking models. Further data reduction can be achieved through the use of overlapped transforms and Time-Domain Aliasing Cancellation (TDAC). The Modified DCT (MDCT) is an example of such overlapped transforms, in which adjacent blocks of samples of the audio signal to be processed overlap each other to avoid discontinuity artifacts while maintaining critical sampling (N samples of the input audio signal yield N transform coefficients). The TDAC property of the MDCT provides this additional advantage in energy compaction.

Recent audio coding models use a multi-mode approach. In this approach, several coding tools can be used to more efficiently encode any type of audio signal (speech, music, mixed, etc). These tools comprise transforms such as the MDCT and predictors such as pitch predictors and Linear Predictive Coding (LPC) filters used in speech coding. When operating a multi-mode codec, transitions between the different coding modes are processed carefully to avoid audible artifacts due to the transition. In particular, shaping of the quantization noise in the different coding modes is typically performed using different procedures. In the frames using transform coding, the quantization noise is shaped in the transform domain (i.e. when quantizing the transform coefficients), applying various quantization steps which are controlled by scale factors derived, for example, from the energy of the audio signal in different spectral bands. On the other hand, in the frames using a predictive model in the time-domain (which typically involves long-term predictors and short-term predictors), the quantization noise is shaped using a so-called weighting filter whose transfer function in the z-transform domain is often denoted W(z). Noise shaping is then applied by first filtering the time-domain samples of the input audio signal through the weighting filter W(z) to obtain a weighted signal, and then encoding the weighted signal in this so-called weighted domain. The spectral shape, or frequency response, of the weighting filter W(z) is controlled such that the coding (or quantization) noise is masked by the input audio signal. Typically, the weighting filter W(z) is derived from the LPC filter, which models the spectral envelope of the input audio signal.

An example of a multi-mode audio codec is the Moving Pictures Expert Group (MPEG) Unified Speech and Audio Codec (USAC). This codec integrates tools including transform coding and linear predictive coding, and can switch between different coding modes depending on the characteristics of the input audio signal. There are three (3) basic coding modes in the USAC:

1) An Advanced Audio Coding (AAC)-based coding mode, which encodes the input audio signal using the MDCT and perceptually-derived quantization of the MDCT coefficients;
2) An Algebraic Code Excited Linear Prediction (ACELP) based coding mode, which encodes the input audio signal as an excitation signal (a time-domain signal) processed through a synthesis filter; and
3) A Transform Coded eXcitation (TCX) based coding mode which is a sort of hybrid between the two previous modes, wherein the excitation of the synthesis filter of the second mode is encoded in the frequency domain; actually, this is a target signal or the weighted signal that is encoded in the transform domain.

In the USAC, the TCX-based coding mode and the AAC-based coding mode use a similar transform, for example the MDCT. However, in their standard form, AAC and TCX do not apply the same mechanism for controlling the spectral shape of the quantization noise. AAC explicitly controls the quantization noise in the frequency domain in the quantization steps of the transform coefficients. TCX however controls the spectral shape of the quantization noise through the use of time-domain filtering, and more specifically through the use of a weighting filter W(z) as described above. To facilitate quantization noise shaping in a multi-mode audio codec, there is a need for a device and method for simultaneous time-domain and frequency-domain noise shaping for TDAC transforms.

DETAILED DESCRIPTION

Figure 1:
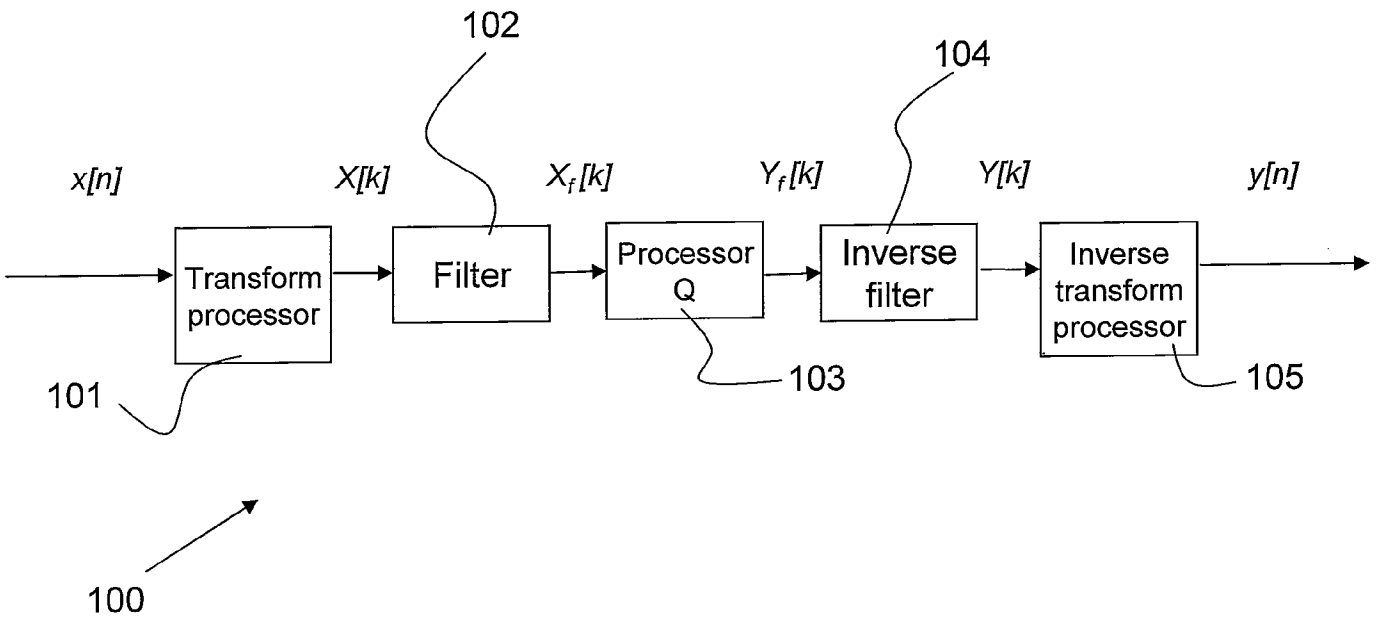
FIG. 1 is a schematic block diagram illustrating the general principle of Temporal Noise Shaping (TNS)

According to a first aspect, the present disclosure relates to a frequency-domain noise shaping method for interpolating a spectral shape and a time-domain envelope of a quantization noise in a windowed and transform-coded audio signal, comprising splitting transform coefficients of the windowed and transform-coded audio signal into a plurality of spectral bands. The frequency-domain noise shaping method also comprises, for each spectral band: calculating a first gain representing, together with corresponding gains calculated for the other spectral bands, a spectral shape of the quantization noise at a first transition between a first time window and a second time window; calculating a second gain representing, together with corresponding gains calculated for the other spectral bands, a spectral shape of the quantization noise at a second transition between the second time window and a third time window; and filtering the transform coefficients of the second time window based on the first and second gains, to interpolate between the first and second transitions the spectral shape and the time-domain envelope of the quantization noise.

According to a second aspect, the present disclosure relates to a frequency-domain noise shaping device for interpolating a spectral shape and a time-domain envelope of a quantization noise in a windowed and transform-coded audio signal, comprising: a splitter of the transform coefficients of the windowed and transform-coded audio signal into a plurality of spectral bands; a calculator, for each spectral band, of a first gain representing, together with corresponding gains calculated for the other spectral bands, a spectral shape of the quantization noise at a first transition between a first time window and a second time window, and of a second gain representing, together with corresponding gains calculated for the other spectral bands, a spectral shape of the quantization noise at a second transition between the second time window and a third time window; and a filter of the transform coefficients of the second time window based on the first and second gains, to interpolate between the first and second transitions the spectral shape and the time-domain envelope of the quantization noise.

According to a third aspect, the present disclosure relates to an encoder for encoding a windowed audio signal, comprising: a first coder of the audio signal in a time-domain coding mode; a second coder of the audio signal is a transform-domain coding mode using a psychoacoustic model and producing a windowed and transform-coded audio signal; a selector between the first coder using the time-domain coding mode and the second coder using the transform-domain coding mode when encoding a time window of the audio signal; and a frequency-domain noise shaping device as described above for interpolating a spectral shape and a time-domain envelope of a quantization noise in the windowed and transform-coded audio signal, thereby achieving a desired spectral shape of the quantization noise at the first and second transitions and a smooth transition of an envelope of this spectral shape from the first transition to the second transition.

According to a fourth aspect, the present disclosure relates to a decoder for decoding an encoded, windowed audio signal, comprising: a first decoder of the encoded audio signal using a time-domain decoding mode; a second decoder of the encoded audio signal using a transform-domain decoding mode using a psychoacoustic model; and a selector between the first decoder using the time-domain decoding mode and the second decoder using the transform-domain decoding mode when decoding a time window of the encoded audio signal; and a frequency-domain noise shaping device as described above for interpolating a spectral shape and a time-domain envelope of a quantization noise in transform-coded windows of the encoded audio signal, thereby achieving a desired spectral shape of the quantization noise at the first and second transitions and a smooth transition of an envelope of this spectral shape from the first transition to the second transition.

In the present disclosure and the appended claims, the term "time window" designates a block of time-domain samples, and the term "windowed signal" designates a time domain window after application of a non-rectangular window.

The basic principle of Temporal Noise Shaping (TNS), referred to in the following description will be first briefly discussed.

TNS is a technique known to those of ordinary skill in the art of audio coding to shape coding noise in time domain. Referring to FIG. 1, a TNS system 100 comprises:

- A transform processor 101 to subject a block of samples of an input audio signal x[n] to a transform, for example the Discrete Cosine Transform (DCT) or the Modified DCT (MDCT), and produce transform coefficients X[k];
- A single filter 102 applied to all the spectral bands, more specifically to all the transform coefficients X[k] from the transform processor 101 to produce filtered transform coefficients $X_f[k]$;
- A processor 103 to quantize, encode, transmit to a receiver or store in a storage device, decode and inverse quantize the filtered transform coefficients $X_f[k]$ to produce quantized transform coefficients $Y_f[k]$;
- A single inverse filter 104 to process the quantized transform coefficients $Y_f[k]$ to produce decoded transform coefficients Y[k]; and, finally,
- An inverse transform processor 105 to apply an inverse transform to the decoded transform coefficients Y[k] to produce a decoded block of output time-domain samples y[n].

Since, in the example of FIG. 1, the transform processor 101 uses the DCT or MDCT, the inverse transform applied in the inverse transform processor 105 is the inverse DCT or inverse MDCT. The single filter 102 of FIG. 1 is derived from an optimal prediction filter for the transform coefficients. This results, in TNS, in modulating the quantization noise with a time-domain envelope which follows the time-domain envelope of the audio signal for the current frame.

Figure 2:
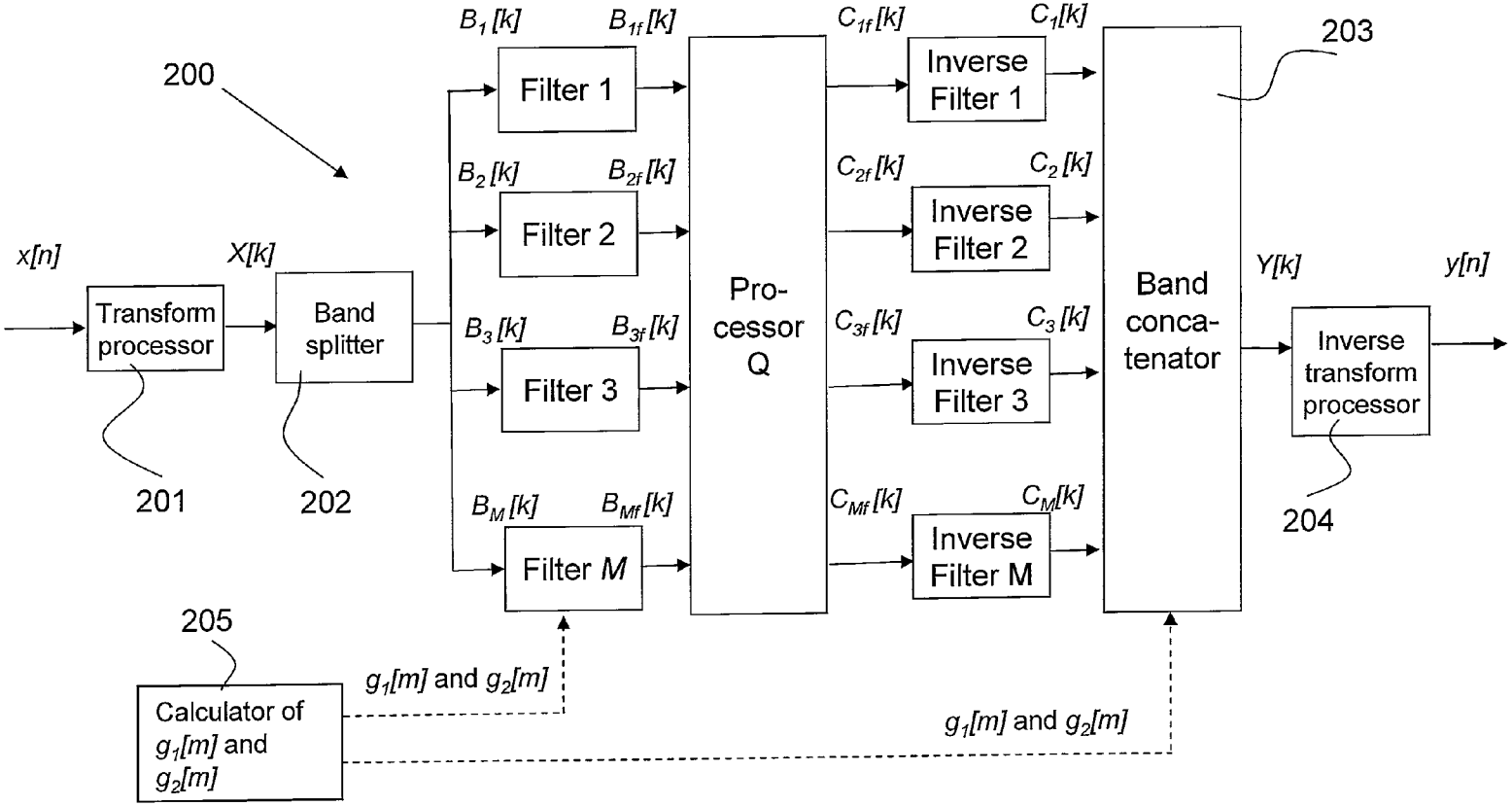
FIG. 2 is a schematic block diagram of a frequency-domain noise shaping device for interpolating a spectral shape and time-domain envelope of quantization noise.
Figure 3:
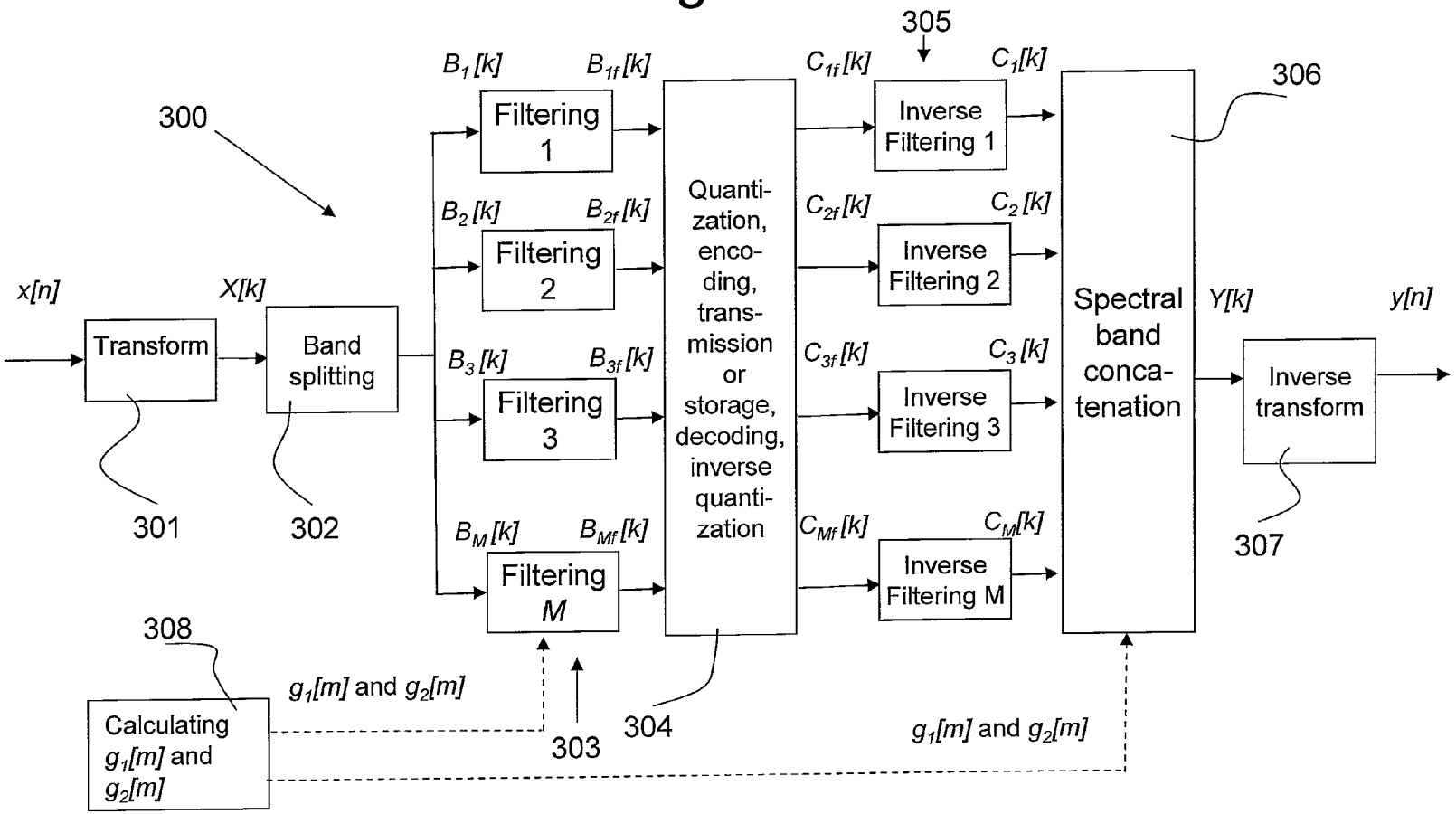
FIG. 3 is a flow chart describing the operations of a frequency-domain noise shaping method for interpolating the spectral shape and time-domain envelope of quantization noise.

With reference to FIGS. 2 and 3, the following disclosure describes concurrently a frequency-domain noise shaping device 200 and method 300 for interpolating the spectral shape and time-domain envelope of quantization noise. More specifically, in the device 200 and method 300, the spectral shape and time-domain amplitude of the quantization noise at the transition between two overlapping transform-coded blocks are simultaneously interpolated. The adjacent transform-coded blocks can be of similar nature such as two consecutive Advanced Audio Coding (AAC) blocks produced by an AAC coder or two consecutive Transform Coded eXcitation (TCX) blocks produced by a TCX coder, but they can also be of different nature such as an AAC block followed by a TCX block, or vice-versa, wherein two distinct coders are used consecutively. Both the spectral shape and the time-domain envelope of the quantization noise evolve smoothly (or are continuously interpolated) at the junction between two such transform-coded blocks.

Operation 301 (FIG. 3)—Transform

The input audio signal x[n] of FIGS. 2 and 3 is a block of N time-domain samples of the input audio signal covering the length of a transform block. For example, the input signal x[n] spans the length of the time-domain window 1 of FIG. 4.

In operation 301, the input signal x[n] is transformed through a transform processor 201 (FIG. 2). For example, the transform processor 201 may implement an MDCT including a time-domain window (for example window 1 of FIG. 4) multiplying the input signal x[n] prior to calculating transform coefficients X[k]. As illustrated in FIG. 2, the transform processor 201 outputs the transform coefficients X[k]. In the non limitative example of a MDCT, the transform coefficients X[k] comprise N spectral coefficients, which is the same as the number of time-domain samples forming the input audio signal x[n].

Operation 302 (FIG. 3)—Band splitting

In operation 302, a band splitter 202 (FIG. 2) splits the transform coefficients X[k] into M spectral bands. More specifically, the transform coefficients X[k] are split into spectral bands $B_1[k]$, $B_2[k]$, $B_3[k]$, . . . , $B_M[k]$. The concatenation of the spectral bands $B_1[k]$, $B_2[k]$, $B_3[k]$, . . . , $B_M[k]$ gives the entire set of transform coefficients, namely B[k]. The number of spectral bands and the number of transform coefficients per spectral band can vary depending on the desired frequency resolution.

Operation 303 (FIG. 3)—Filtering 1, 2, 3, . . . , M

After band splitting 302, in operation 303, each spectral band $B_1[k]$, $B_2[k]$, $B_3[k]$, . . . , $B_M[k]$ is filtered through a band-specific filter (Filters 1, 2, 3, . . . , M in FIG. 2). Filters 1, 2, 3, . . . , M can be different for each spectral band, or the same filter can be used for all spectral bands. In an embodiment, Filters 1, 2, 3, . . . , M of FIG. 2 are different for each block of samples of the input audio signal x[n]. Operation 303 produces the filtered bands $B_{1f}[k]$, $B_{2f}[k]$, $B_3[k]$, . . . , $B_{Mf}[k]$ of FIGS. 2 and 3.

Operation 304 (FIG. 3)—Quantization, encoding, transmission or storage, decoding, inverse quantization In operation 304, the filtered bands $B_{1f}[k]$, $B_{2f}[k]$, $B_{3f}[k]$, . . . , $B_{Mf}[k]$ from Filters 1, 2, 3, . . . , M may be quantized, encoded, transmitted to a receiver (not shown) and/or stored in any storage device (not shown). The quantization, encoding, transmission to a receiver and/or storage in a storage device are performed in and/or controlled by a Processor Q of FIG. 2. The Processor Q may be further connected to and control a transceiver (not shown) to transmit the quantized, encoded filtered bands $B_{1f}[k]$, $B_{2f}[k]$, $B_{3f}[k]$, . . . , $B_{Mf}[k]$ to the receiver. In the same manner, The Processor Q may be connected to and control the storage device for storing the quantized, encoded filtered bands $B_{1f}[k]$, $B_{2f}[k]$, $B_{3f}[k]$, . . . , $B_{Mf}[k]$.

In operation 304, quantized and encoded filtered bands $B_{1f}[k]$, $B_{2f}[k]$, $B_3[k]$, . . . , $B_{Mf}[k]$ may also be received by the transceiver or retrieved from the storage device, decoded and inverse quantized by the Processor Q. These operations of receiving (through the transceiver) or retrieving (from the storage device), decoding and inverse quantization produce quantized spectral bands $C_{1f}[k]$, $C_{2f}[k]$, $C_{3f}[k]$, . . . , $C_{Mf}[k]$ at the output of the Processor Q.

Any type of quantization, encoding, transmission (and/or storage), receiving, decoding and inverse quantization can be used in operation 304 without loss of generality.

Operation 305 (FIG. 3)—Inverse Filtering 1, 2, 3, . . . , M

In operation 305, the quantized spectral bands $C_{1f}[k]$, $C_{2f}[k]$, $C_{3f}[k]$, . . . , $C_{Mf}[k]$ are processed through inverse filters, more specifically inverse Filter 1, inverse Filter 2, inverse Filter 3, . . . , inverse filter M of FIG. 2, to produce decoded spectral bands $C_1[k]$, $C_2[k]$, $C_3[k]$, . . . , $C_M[k]$. The inverse Filter 1, inverse Filter 2, inverse Filter 3, . . . , inverse filter M have transfer functions inverse of the transfer functions of Filter 1, Filter 2, Filter 3, . . . , Filter M, respectively.

Operation 306 (FIG. 3) - Spectral band concatenation

In operation 306, the decoded spectral bands $C_1[k]$, $C_2[k]$, $C_3[k]$, . . . , $C_M[k]$ are then concatenated in a band concatenator 203 of FIG. 2, to yield decoded spectral coefficients Y[k] (decoded spectrum).

Operation 307 (FIG. 3)—Inverse transform

Finally, in operation 307, an inverse transform processor 204 (FIG. 2) applies an inverse transform to the decoded spectral coefficients Y[k] to produce a decoded block of output time-domain samples y[n]. In the case of the above non-limitative example using the MDCT, the inverse transform processor 204 applies the inverse MDCT (IMDCT) to the decoded spectral coefficients Y[k].

Operation 308 (FIG. 3)—Calculating noise gains $g_1[m]$ and $g_2[m]$

In FIG. 2, Filter 1, Filter 2, Filter 3, . . . , Filter M and inverse Filter 1, inverse Filter 2, inverse Filter 3, . . . , inverse Filter M use parameters (noise gains) $g_1[m]$ and $g_2[m]$ as input. These noise gains represent spectral shapes of the quantization noise and will be further described herein below. Also, the Filterings 1, 2, 3, . . . , M of FIG. 3 may be sequential; Filter 1 may be applied before Filter 2, then Filter 3, and so on until Filter M (FIG. 2). The inverse Filterings 1, 2, 3, . . . , M may also be sequential; inverse Filter 1 may be applied before inverse Filter 2, then inverse Filter 3, and so on until inverse Filter M (FIG. 2). As such, each filter and inverse filter may use as an initial state the final state of the previous filter or inverse filter. This sequential operation may ensure continuity in the filtering process from one spectral band to the next. In one embodiment, this continuity constraint in the filter states from one spectral band to the next may not be applied.

Figure 4:
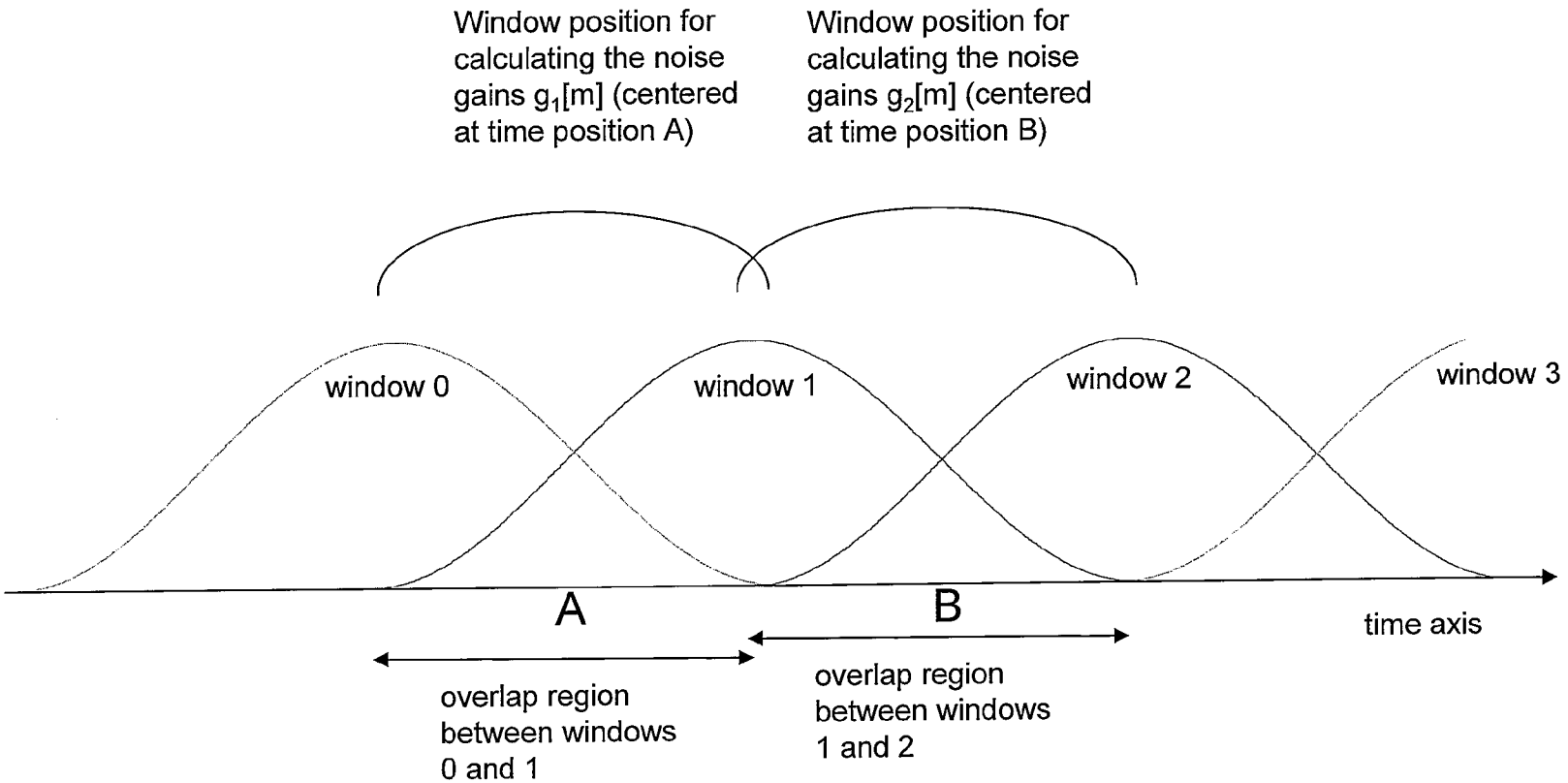
FIG. 4 is a schematic diagram of relative window positions for transforms and noise gains, considering calculation of the noise gains for window 1.

FIG. 4 illustrates how the frequency-domain noise shaping for interpolating the spectral shape and time-domain envelope of quantization noise can be used when processing an audio signal segmented by overlapping windows (window 0, window 1, window 2 and window 3) into adjacent overlapping transform blocks (blocks of samples of the input audio signal). Each window of FIG. 4, i.e. window 0, window 1, window 2 and window 3, shows the time span of a transform block and the shape of the window applied by the transform processor 201 of FIG. 2 to that block of samples of the input audio signal. As described hereinabove, the transform processor 201 of FIG. 2 implements both windowing of the input audio signal x[n] and application of the transform to produce the transform coefficients X[k]. The shape of the windows (window 0, window 1, window 2 and window 3) shown in FIG. 4 can be changed without loss of generality.

In FIG. 4, processing of a block of samples of the input audio signal x[n] from beginning to end of window 1 is considered. The block of samples of the input audio signal x[n] is supplied to the transform processor 201 of FIG. 2. In the calculating operation 308 (FIG. 3), the calculator 205 (FIG. 2) computes two sets of noise gains $g_1[m]$ and $g_2[m]$ used for the filtering operations (Filters 1 to M and inverse Filters 1 to M). These two sets of noise gains actually represent desired levels of noise in the M spectral bands at a given position in time. Hence, the noise gains $g_1[m]$ and $g_2[m]$ each represent the spectral shape of the quantization noise at such position on the time axis. In FIG. 4, the noise gains $g_1[m]$ correspond to some analysis centered at point A on the time axis, and the noise gains $g_2[m]$ correspond to another analysis further up on the time axis, at position B. For optimal operation, analyses of these noise gains are centered at the middle point of the overlap between adjacent windows and corresponding blocks of samples. Accordingly, referring to FIG. 4, the analysis to obtain the noise gains $g_1[m]$ for window 1 is centered at the middle point of the overlap (or transition) between window 0 and window 1 (see point A on the time axis). Also, the analysis to obtain the noise gains $g_2[m]$ for window 1 is centered at the middle point of the overlap (or transition) between window 1 and window 2 (see point B on the time axis).

A plurality of different analysis procedures can be used by the calculator 205 (FIG. 2) to obtain the sets of noise gains $g_1[m]$ and $g_2[m]$, as long as such analysis procedure leads to a set of suitable noise gains in the frequency domain for each of the M spectral bands $B_1[k]$, $B_2[k]$, $B_3[k]$, . . . , $B_M[k]$ of FIGS. 2 and 3. For example, a Linear Predictive Coding (LPC) can be applied to the input audio signal x[n] to obtain a short-term predictor from which a weighting filter W(z) is derived. The weighting filter W(z) is then mapped into the frequency-domain to obtain the noise gains $g_1[m]$ and $g_2[m]$. This would be a typical analysis procedure usable when the block of samples of the input signal x[n] in window 1 of FIG. 4 is encoded in TCX mode. Another approach to obtain the noise gains $g_1[m]$ and $g_2[m]$ of FIGS. 2 and 3 could be as in AAC, where the noise level in each frequency band is controlled by scale factors (derived from a psychoacoustic model) in the MDCT domain.

Figure 5:
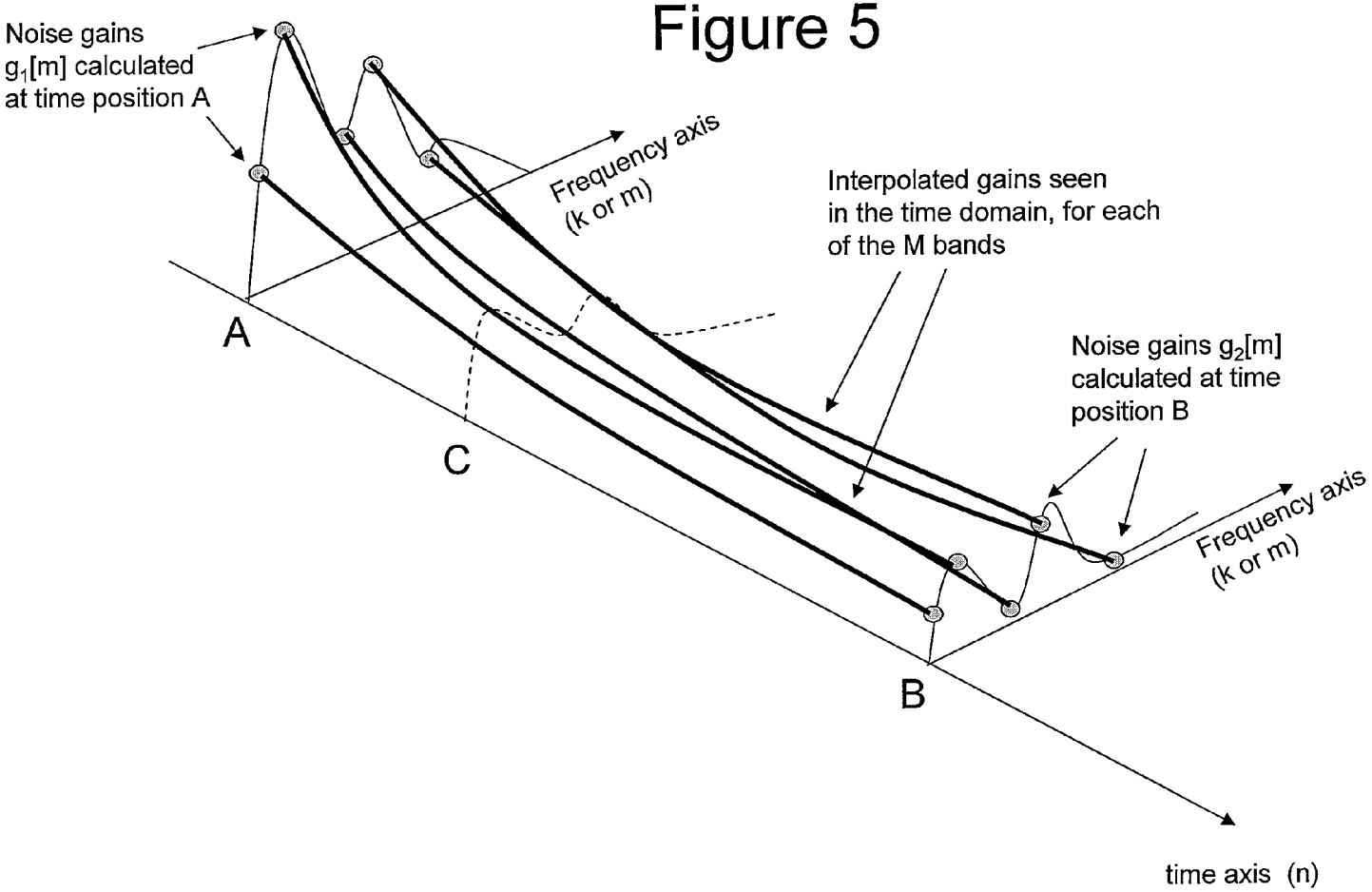
FIG. 5 is a graph illustrating the effect of noise shape interpolation, both on the spectral shape and the time-domain envelope of the quantization noise.

Having processed through the transform processor 201 of FIG. 2 the block of samples of the input signal x[n] spanning the length of window 1 of FIG. 4, and having obtained the sets of noise gains $g_1[m]$ and $g_2[m]$ at positions A and B on the time axis of FIG. 4 using the calculator 205, the filtering operations for each spectral band $B_1[k]$, $B_2[k]$, $B_3[k]$, . . . , $B_M[k]$ of FIG. 2 are performed. The object of the filtering (and inverse filtering) operations is to achieve a desired spectral shape of the quantization noise at positions A and B on the time axis, and also to ensure a smooth transition or interpolation of this spectral shape or the envelope of this spectral shape from point A to point B, on a sample-by-sample basis. This is shown in FIG. 5, in which an illustration of the noise gains $g_1[m]$ is shown at point A and an illustration of the noise gains $g_2[m]$ is shown at point B. If each of the spectral bands $B_1[k]$, $B_2[k]$, $B_3[k]$, . . . , $B_M[k]$ were simply multiplied by a function of the noise gains $g_1[m]$ and $g_2[m]$, for example by taking a weighted sum of $g_1[m]$ and $g_2[m]$ and multiplying by this result the coefficients in spectral band $B_m[k]$, m taking one of the values 1, 2, 3, . . . , M, then the interpolated gain curves shown in FIG. 5 would be constant (horizontal) from point A to point B. To obtain smoothly varying noise gain curves from gain $g_1[m]$ to gain $g_2[m]$ for each spectral band as shown in FIG. 5, filtering can be applied to each spectral band $B_m[k]$. By the duality property of many linear transforms, in particular the DCT and MDCT, a filtering (or convolution) operation in one domain results in a multiplication in the other domain. Accordingly, filtering the transform coefficients in one spectral band $B_m[k]$ results in interpolating and applying a time-domain envelope (multiplication) to the quantization noise in that spectral band. This is the basis of TNS, which principle is briefly presented in the foregoing description of FIG. 1.

Figure 6:
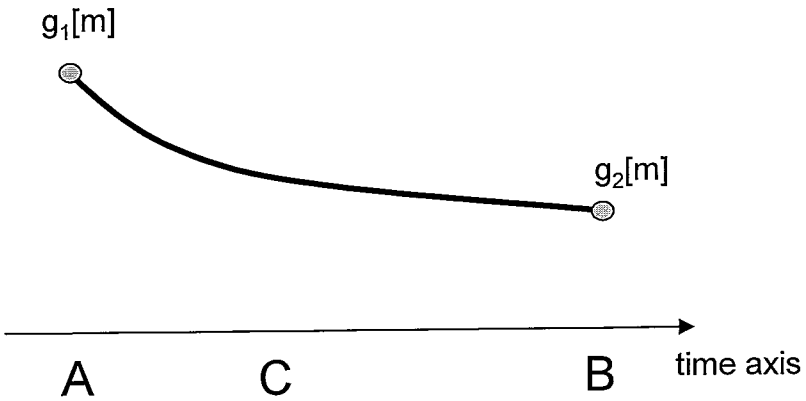
FIG. 6 is a graph illustrating a $m^{th}$ time-domain envelope, which can be seen as the noise shape in a $m^{th}$ spectral band evolving in time from point A to point B.

However, there are fundamental differences between TNS and the herein proposed interpolation. As a first difference between TNS and the herein disclosed technique, the objective and processing are different. In the herein disclosed technique, the objective is to impose, for the duration of a given window (for example window 1 of FIG. 4), a time-domain envelope for the quantization noise in a given band $B_m[k]$ which smoothly varies from the noise gain $g_1[m]$ calculated at point A to the noise gain $g_2[m]$ calculated at point B. FIG. 6 shows an example of interpolated time-domain envelope of the noise gain, for spectral band $B_m[k]$. There are several possibilities for such an interpolated curve, and the corresponding frequency-domain filter for that spectral band $B_m[k]$. For example, a first-order recursive filter structure can be used for each spectral band. Many other filter structures are possible, without loss of generality.

Since the objective is to shape, through filtering, the quantization noise in each spectral band $B_m[k]$, first concern is directed to the inverse Filters 1 to M of FIG. 2, which is the inverse filtering operation that will shape the quantization noise introduced by processor Q (FIG. 2).

If we consider then that the quantized transform coefficients $Y_f[k]$ of the spectral band $C_{mf}[k]$ are filtered as follows $$C_{mf}[k]=aC_{mf}[k]+bC_{mf}[k-1] \tag{1}$$

using filter parameters a and b. Equation (1) represents a first-order recursive filter, applied to the transform coefficients of spectral band $C_{mf}[k]$. As stated above, it is possible to use other filter structures.

To understand the effect, in time-domain, of the filter of Equation (1) applied in the frequency-domain, use is made of a duality property of Fourier transforms which applies in particular to the MDCT. This duality property states that a convolution (or filtering) of a signal in one domain is equivalent to a multiplication (or actually, a modulation) of the signal in the other domain. For example, if the following filter is applied to a time-domain signal x[n]:

$$y[n]=ax[n]+by[n-1] \tag{2}$$

where x[n] is the input of the filter and y[n] is the output of the filter, then this is equivalent to multiplying the transform of the input x[n], which can be noted $X(e^{j\theta})$, by:

$$H(e^{j\theta}) = \frac{a}{1-be^{-j\theta}} \tag{3}$$

In Equation (3), θ is the normalized frequency (in radians per sample) and $H(e^{j\theta})$ is the transfer function of the recursive filter of Equation (2). What is used is the value of $H(e^{j\theta})$ at the beginning (θ=0) and end (θ=π) of the frequency domain scale. It is easy to show that, for Equation (3), $$H(e^{j0}) = \frac{a}{1-b} \tag{4}$$

$$H(e^{j\pi}) = \frac{a}{1+b} \tag{5}$$

Equations (4) and (5) represent the initial and final values of the curve described by Equation (3). In between those two points, the curve will evolve smoothly between the initial and final values. For the Discrete Fourier Transform (DFT), which is a complex-valued transform, this curve will have complex values. But for other real-valued transforms such as the DCT and MDCT, this curve will exhibit real values only.

Now, because of the duality property of the Fourier transform, if the filtering of Equation (2) is applied in the frequency-domain as in Equation (1), then this will have the effect of multiplying the time-domain signal by a smooth envelope with initial and final values as in Equations (4) and (5). This time-domain envelope will have a shape that could look like the curve of FIG. 6. Further, if the frequency-domain filtering as in Equation (1) is applied only to one spectral band, then the time-domain envelope produced is only related to that spectral band. The other filters amongst inverse Filter 1, inverse Filter 2, inverse Filter 3, . . . , inverse Filter M of FIGS. 2 and 3 will produce different time-domain envelopes for the corresponding spectral bands such as those shown in FIG. 5.

It is reminded that these time-domain envelopes of each spectral band are made equal, at the beginning and the end of a block of samples of the input signal x[n] (for example window 1 of FIG. 4), to the noise gains $g_1[m]$ and $g_2[m]$ calculated at these time instants. For the $m^{th}$ spectral band, the noise gain at the beginning of the block of samples of the input signal x[n] (frame) is $g_1[m]$ and the noise gain at the end of the block of samples of the input signal x[n] (frame) is $g_2[m]$. Between those beginning (A) and end (B) points, the time-domain envelopes (one per spectral band) are made, more specifically interpolated to vary smoothly in time such that the noise gain in each spectral band evolve smoothly in the time-domain signal. In this manner, the spectral shape of the quantization noise evolves smoothly in time, from point A to point B. This is shown in FIG. 5. The dotted spectral shape at time instant C represents the instantaneous spectral shape of the quantization noise at some time instant between the beginning and end of the segment (points A and B).

For the specific case of the frequency-domain filter of Equation (1), this implies the following constraints to determine parameters a and b in the filter equation from the noise gains $g_1[m]$ and $g_2[m]$:

$$g_1[m] = \frac{a}{1-b} \tag{6}$$

$$g_2[m] = \frac{a}{1+b} \tag{7}$$

To simplify notation, let us set $g_1=g_1[m]$ and $g_2=g_2[m]$, and remember that this is only for spectral band $B_m[k]$. The following relations are obtained:

$$g_1 = \frac{a}{1-b} \tag{8}$$

$$g_2 = \frac{a}{1+b} \tag{9}$$

From Equations (8) and (9), it is straightforward, for each inverse Filter 1, 2, 3, . . . , M, to calculate the filter coefficients a and b as a function of $g_1$ and $g_2$. The following relations are obtained:

$$a = -2\left(\frac{g_1 g_2}{g_1 + g_2}\right) \tag{10}$$

$$b = \frac{g_1 - g_2}{g_1 + g_2} \tag{11}$$

To summarize, coefficients a and b in Equations (10) and (11) are the coefficients to use in the frequency-domain filtering of Equation (1) in order to temporally shape the quantization noise in that $m^{th}$ spectral band such that it follows the time-domain envelope shown in FIG. 6. In the special case of the MDCT used as the transform in transform processor 201 of FIG. 2, the signs of Equations (10) and (11) are reversed, that is the filter coefficients to use in Equation (1) become:

$$a = 2\left(\frac{g_1 g_2}{g_1 + g_2}\right) \tag{12}$$

$$b = \frac{g_2 - g_1}{g_1 + g_2} \tag{13}$$

This time-domain reversal of the Time-Domain Aliasing Cancellation (TDAC) is specific to the special case of the MDCT.

Now, the inverse filtering of Equation (1) shapes both the quantization noise and the signal itself. To ensure a reversible process, more specifically to ensure that y[n]=x[n] in FIGS. 2 and 3 if the quantization noise is zero, a filtering through Filter 1, Filter 2, Filter 3, . . . , Filter M is also applied to each spectral band $B_m[k]$ before the quantization in Processor Q (FIG. 2). Filter 1, Filter 2, Filter 3, . . . , Filter M of FIG. 2 form pre-filters (i.e. filters prior to quantization) that are actually the "inverse" of the inverse Filter 1, inverse Filter 2, inverse Filter 3, . . . , inverse Filter M. In the specific case of Equation (1) representing the transfer function of the inverse Filter 1, inverse Filter 2, inverse Filter 3, . . . , inverse Filter M, the filters prior to quantization, more specifically Filter 1, Filter 2, Filter 3, . . . , Filter M of FIG. 2 are defined by:

$$B_{mf}[k]=aB_m[k]-bB_m[k-1] \tag{14}$$

In Equation (14), coefficients a and b calculated for the Filters 1, 2, 3, . . . , M are the same as in Equations (10) and (11), or Equations (12) and (13) for the special case of the MDCT. Equation (14) describes the inverse of the recursive filter of Equation (1). Again, if another type or structure of filter different from that of Equation (1) is used, then the inverse of this other type or structure of filter is used instead of that of Equation (14).

Another aspect is that the concept can be generalized to any shapes of quantization noise at points A and B of the windows of FIG. 4, and is not constrained to noise shapes having always the same resolution (same number of spectral bands M and same number of spectral coefficients X[k] per band). In the foregoing disclosure, it was assumed that the number M of spectral bands $B_m[k]$ is the same in the noise gains $g_1[m]$ and $g_2[m]$, and that each spectral band has the same number of transform coefficients X[k]. But actually, this can be generalized as follows: when applying the frequency-domain filterings as in Equations (1) and (14), the filter coefficients (for example coefficients a and b) may be recalculated whenever the noise gain at one frequency bin k changes in either of the noise shape descriptions at point A or point B. As an example, if at point A of FIG. 4, the noise shape is a constant (only one gain for the whole frequency axis) and at point B of FIG. 5 there are as many different noise gains as the number N of transform coefficients X[k] (input signal x[n] after application of a transform in transform processor 201 of FIG. 2). Then, when applying the frequency domain filterings of Equations (1) and (14), the filter coefficients would be recalculated at every frequency component, even though the noise description at point A does not change over all coefficients. The interpolated noise gains of FIG. 5 would all start from the same amplitude (constant noise gain at point A) and converge towards the different individual noise gains at the different frequencies at point B.

Such flexibility allows the use of the frequency-domain noise shaping device 200 and method 300 for interpolating the spectral shape and time-domain envelope of quantization noise in a system in which the resolution of the shape of the spectral noise changes in time. For example, in a variable bit rate codec, there might be enough bits at some frames (point A or point B in FIGS. 4 and 5) to refine the description of noise gains by adding more spectral bands or changing the frequency resolution to better follow so-called critical spectral bands, or using a multi-stage quantization of the noise gains, and so on. The filterings and inverse filterings of FIGS. 2 and 3, described hereinabove as operating per spectral band, can actually be seen as one single filtering (or one single inverse filtering) one frequency component at a time whereby the filter coefficients are updated whenever either the start point or the end point of the desired noise envelope changes in a noise level description.

Figure 7:
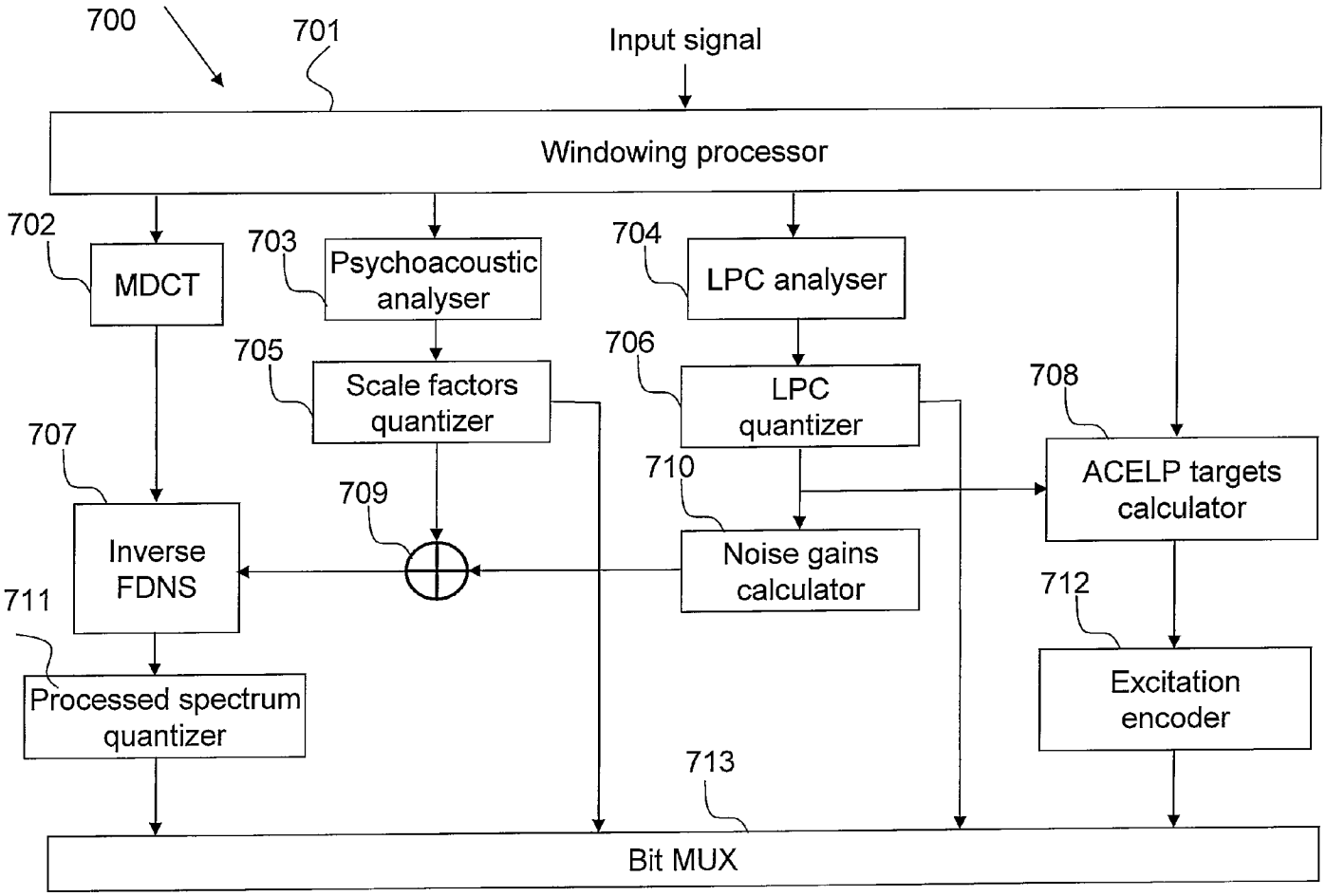
FIG. 7 is a schematic block diagram of an encoder capable of switching between a frequency-domain coding mode using, for example, MDCT and a time-domain coding mode using, for example, ACELP, the encoder applying Frequency Domain Noise Shaping (FNDS) to encode a block of samples of an input audio signal.

Illustrated in FIG. 7 is an encoder 700 for coding audio signals, the principle of which can be used for example in the multi-mode Moving Pictures Expert Group (MPEG) Unified Speech and Audio Codec (USAC). More specifically, the encoder 700 is capable of switching between a frequency-domain coding mode using, for example, MDCT and a time-domain coding mode using, for example, ACELP, In this particular example, the encoder 700 comprises: an ACELP coder including an LPC quantizer which calculates, encodes and transmits LPC coefficients from an LPC analysis; and a transform-based coder using a perceptual model (or psychoacoustical model) and scale factors to shape the quantization noise of spectral coefficients. The transform-based coder comprises a device as described hereinabove, to simultaneously shape in the time-domain and frequency-domain the quantization noise of the transform-based coder between two frame boundaries of the transform-based coder. in which quantization noise gains can be described by either only the information from the LPC coefficients, or only the information from scale factors, or any combination of the two. A selector (not shown) chooses between the ACELP coder using the time-domain coding mode and the transform-based coder using the transform-domain coding mode when encoding a time window of the audio signal, depending for example on the type of the audio signal to be encoded and/or the type of coding mode to be used for that type of audio signal.

Still referring to FIG. 7, windowing operations are first applied in windowing processor 701 to a block of samples of an input audio signal. In this manner, windowed versions of the input audio signal are produced at outputs of the windowing processor 701. These windowed versions of the input audio signal have possibly different lengths depending on the subsequent processors in which they will be used as input in FIG. 7.

As described hereinabove, the encoder 700 comprises an ACELP coder including an LPC quantizer which calculates, encodes and transmits the LPC coefficients from an LPC analysis. More specifically, referring to FIG. 7, the ACELP coder of the encoder 700 comprises an LPC analyser 704, an LPC quantizer 706, an ACELP targets calculator 708 and an excitation encoder 712. The LPC analyser 704 processes a first windowed version of the input audio signal from processor 701 to produce LPC coefficients. The LPC coefficients from the LPC analyser 704 are quantized in an LPC quantizer 706 in any domain suitable for quantization of this information. In an ACELP frame, noise shaping is applied as well know to those of ordinary skill in the art as a time-domain filtering, using a weighting filter derived from the LPC filter (LPC coefficients). This is performed in ACELP targets calculator 708 and excitation encoder 712. More specifically, calculator 708 uses a second windowed version of the input audio signal (using typically a rectangular window) and produces in response to the quantized LPC coefficients from the quantizer 706 the so called target signals in ACELP encoding. From the target signals produced by the calculator 708, encoder 712 applies a procedure to encode the excitation of the LPC filter for the current block of samples of the input audio signal.

As described hereinabove, the system 700 of FIG. 7 also comprises a transform-based coder using a perceptual model (or psychoacoustical model) and scale factors to shape the quantization noise of the spectral coefficients, wherein the transform-based coder comprises a device to simultaneously shape in the time-domain and frequency-domain the quantization noise of the transform-based encoder. The transform-based coder comprises, as illustrated in FIG. 7, a MDCT processor 702, an inverse FDNS processor 707, and a processed spectrum quantizer 711, wherein the device to simultaneously shape in the time-domain and frequency-domain the quantization noise of the transform-based coder comprises the inverse FDNS processor 707. A third windowed version of the input audio signal from windowing processor 701 is processed by the MDCT processor 702 to produce spectral coefficients. The MDCT processor 702 is a specific case of the more general processor 201 of FIG. 2 and is understood to represent the MDCT (Modified Discrete Cosine Transform). Prior to being quantized and encoded (in any domain suitable for quantization and encoding of this information) for transmission by quantizer 711, the spectral coefficients from the MDCT processor 702 are processed through the inverse FDNS processor 707. The operation of the inverse FDNS processor 707 is as in FIG. 2, starting with the spectral coefficients X[k] (FIG. 2) as input to the FDNS processor 707 and ending before processor Q (FIG. 2). The inverse FDNS processor 707 requires as input sets of noise gains $g_1[m]$ and $g_2[m]$ as described in FIG. 2. The noise gains are obtained from the adder 709, which adds two inputs: the output of a scale factors quantizer 705 and the output of a noise gains calculator 710. Any combination of scale factors, for example from a psychoacoustic model, and noise gains, for example from an LPC model, are possible, from using only scale factors to using only noise gains, to any combination or proportion of the scale factors and noise gains. For example, the scale factors from the psychoacoustic model can be used as a second set of gains or scale factors to refine, or correct, the noise gains from the LPC model. Accordingly to another alternative, the combination of the noise gains and scale factors comprises the sum of the noise gains and scale factors, where the scale factors are used as a correction to the noise gains. To produce the quantized scale factors at the output of quantizer 705, a fourth windowed version of the input signal from processor 701 is processed by a psychoacoustic analyser 703 which produces unquantized scale factors which are then quantized by quantizer 705 in any domain suitable for quantization of this information. Similarly, to produce the noise gains at the output of calculator 710, a noise gains calculator 710 is supplied with the quantized LPC coefficients from the quantizer 706. In a block of input signal where the encoder 700 would switch between an ACELP frame and an MDCT frame, FDNS is only applied to the MDCT-encoded samples.

The bit multiplexer 713 receives as input the quantized and encoded spectral coefficients from processed spectrum quantizer 711, the quantized scale factors from quantizer 705, the quantized LPC coefficients from LPC quantizer 706 and the encoded excitation of the LPC filter from encoder 712 and produces in response to these encoded parameters a stream of bits for transmission or storage.

Figure 8:
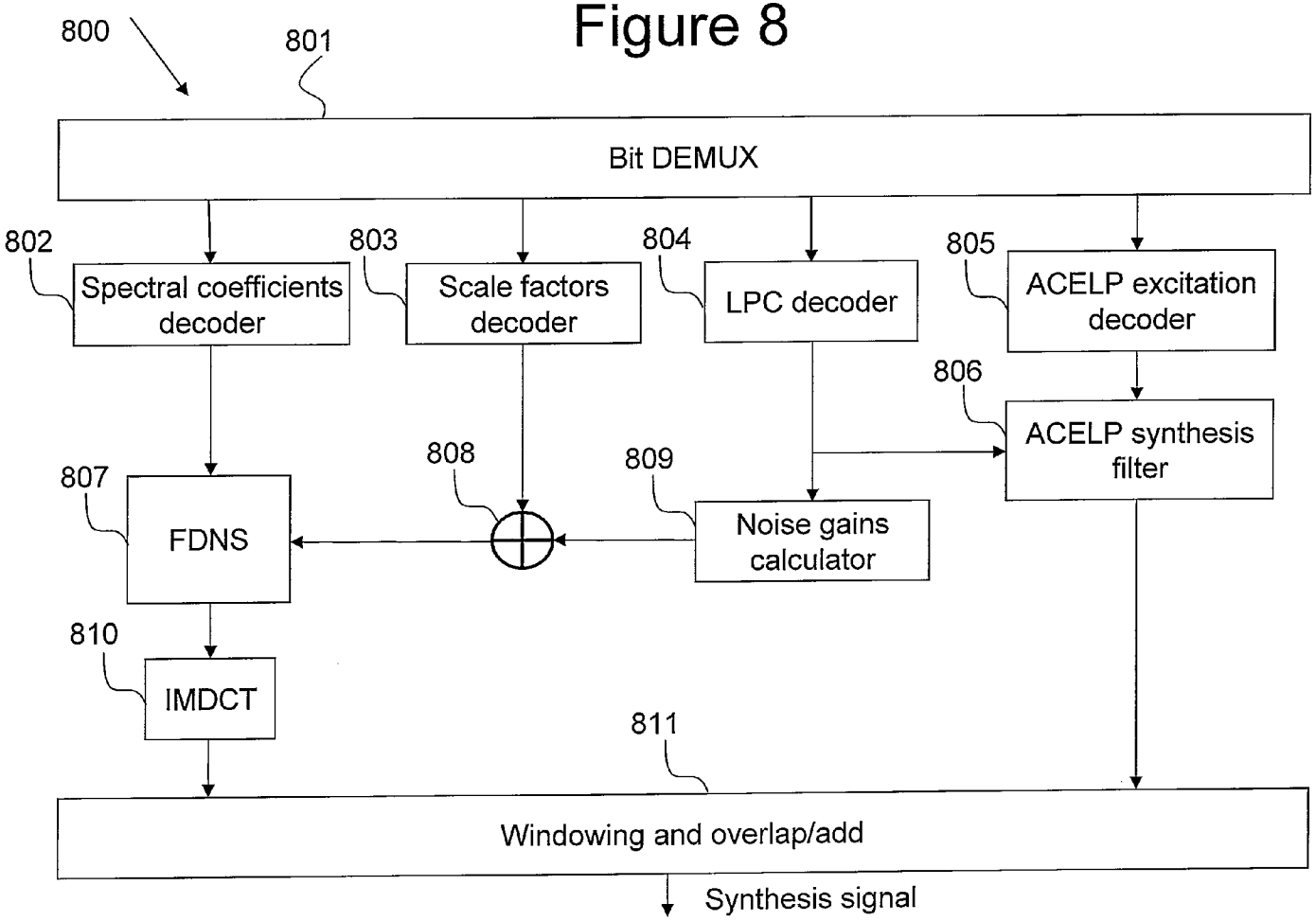
FIG. 8 is a schematic block diagram of a decoder producing a block of synthesis signal using FDNS, wherein the decoder can switch between a frequency-domain coding mode using, for example, MDCT and a time-domain coding mode using, for example, ACELP.

Illustrated in FIG. 8 is a decoder 800 producing a block of synthesis signal using FDNS, wherein the decoder can switch between a frequency-domain decoding mode using, for example, IMDCT and a time-domain decoding mode using, for example, ACELP. A selector (not shown) chooses between the ACELP decoder using the time-domain decoding mode and the transform-based decoder using the transform-domain coding mode when decoding a time window of the encoding audio signal, depending on the type of encoding of this audio signal.

The decoder 800 comprises a demultiplexer 801 receiving as input the stream of bits from bit multiplexer 713 (FIG. 7). The received stream of bits is demultiplexed to recover the quantized and encoded spectral coefficients from processed spectrum quantizer 711, the quantized scale factors from quantizer 705, the quantized LPC coefficients from LPC quantizer 706 and the encoded excitation of the LPC filter from encoder 712.

The recovered quantized LPC coefficients (transform-coded window of the windowed audio signal) from demultiplexer 801 are supplied to a LPC decoder 804 to produce decoded LPC coefficients. The recovered encoded excitation of the LPC filter from demultiplexer 301 is supplied to and decoded by an ACELP excitation decoder 805. An ACELP synthesis filter 806 is responsive to the decoded LPC coefficients from decoder 804 and to the decoded excitation from decoder 805 to produce an ACELP-decoded audio signal.

The recovered quantized scale factors are supplied to and decoded by a scale factors decoder 803.

The recovered quantized and encoded spectral coefficients are supplied to a spectral coefficient decoder 802. Decoder 802 produces decoded spectral coefficients which are used as input by a FDNS processor 807. The operation of FDNS processor 807 is as described in FIG. 2, starting after processor Q and ending before processor 204 (inverse transform processor). The FDNS processor 807 is supplied with the decoded spectral coefficients from decoder 802, and an output of adder 808 which produces sets of noise gains, for example the above described sets of noise gains $g_1[m]$ and $g_2[m]$ resulting from the sum of decoded scale factors from decoder 803 and noise gains calculated by calculator 809. Calculator 809 computes noise gains from the decoded LPC coefficients produced by decoder 804. As in the encoder 700 (FIG. 7), any combination of scale factors (from a psychoacoustic model) and noise gains (from an LPC model) are possible, from using only scale factors to using only noise gains, to any proportion of scale factors and noise gains. For example, the scale factors from the psychoacoustic model can be used as a second set of gains or scale factors to refine, or correct, the noise gains from the LPC model. Accordingly to another alternative, the combination of the noise gains and scale factors comprises the sum of the noise gains and scale factors, where the scale factors are used as a correction to the noise gains. The resulting spectral coefficients at the output of the FDNS processor 807 are subjected to an IMDCT processor 810 to produce a transform-decoded audio signal.

Finally, a windowing and overlap/add processor 811 combines the ACELP-decoded audio signal from the ACELP synthesis filter 806 with the transform-decoded audio signal from the IMDCT processor 810 to produce a synthesis audio signal.

What is claimed is:

1. A frequency-domain noise shaping method for interpolating a spectral shape and a time-domain envelope of a quantization noise in a windowed and transform-coded audio signal, comprising:

splitting transform coefficients of the windowed and transform-coded audio signal into a plurality of spectral bands; and for each spectral band:

calculating a first gain representing, together with corresponding gains calculated for the other spectral bands, a spectral shape of the quantization noise at a first transition between a first time window and a second time window;

calculating a second gain representing, together with corresponding gains calculated for the other spectral bands, a spectral shape of the quantization noise at a second transition between the second time window and a third time window; and an operation of filtering the transform coefficients of the second time window, the filtering operation receiving as first input the transform coefficients of the second time window and as second input the first and second gains to filter said transform coefficients of the second time window using the second input, first and second gains to interpolate between the first and second transitions the spectral shape and the time-domain envelope of the quantization noise.

2. A frequency-domain noise shaping method for interpolating a spectral shape and a time-domain envelope of a quantization noise in a windowed and transform-coded audio signal, comprising:

splitting transform coefficients of the windowed and transform-coded audio signal into a plurality of spectral bands; and for each spectral band:

calculating a first gain representing, together with corresponding gains calculated for the other spectral bands, a spectral shape of the quantization noise at a first transition between a first time window and a second time window;

calculating a second gain representing, together with corresponding gains calculated for the other spectral bands, a spectral shape of the quantization noise at a second transition between the second time window and a third time window; and an operation of filtering the transform coefficients of the second time window, the filtering operation receiving as first input the transform coefficients of the second time window and as second input the first and second gains to filter said transform coefficients of the second time window using the second input, first and second gains to interpolate between the first and second transitions the spectral shape and the time-domain envelope of the quantization noise;

wherein the windowed and transform-coded audio signal is windowed using successive overlapping windows, wherein the first gain is a noise gain calculated at a middle point of an overlap between the first and second time windows, and wherein the second gain is a noise gain calculated at a middle point of an overlap between the second and third time windows.

3. The frequency-domain noise shaping method of claim 1, wherein calculating the first gain and calculating the second gain comprises applying a linear predictive coding to the windowed and transform-coded audio signal.

4. A frequency-domain noise shaping method for interpolating a spectral shape and a time-domain envelope of a quantization noise in a windowed and transform-coded audio signal, comprising:

splitting transform coefficients of the windowed and transform-coded audio signal into a plurality of spectral bands; and for each spectral band:

calculating a first gain representing, together with corresponding gains calculated for the other spectral bands, a spectral shape of the quantization noise at a first transition between a first time window and a second time window;

calculating a second gain representing, together with corresponding gains calculated for the other spectral bands, a spectral shape of the quantization noise at a second transition between the second time window and a third time window; and an operation of filtering the transform coefficients of the second time window, the filtering operation receiving as first input the transform coefficients of the second time window and as second input the first and second gains to filter said transform coefficients of the second time window using the second input, first and second gains to interpolate between the first and second transitions the spectral shape and the time-domain envelope of the quantization noise;

wherein filtering the transform coefficients comprises achieving a desired spectral shape of the quantization noise at the first and second transitions and a smooth transition of an envelope of this spectral shape from the first transition to the second transition.

5. The frequency-domain noise shaping method of claim 1, wherein filtering the transform coefficients is made prior to quantization of the transform coefficients producing the quantization noise.

6. The frequency-domain noise shaping method of claim 1, wherein filtering the transform coefficients is made after quantization of the transform coefficients producing the quantization noise.

7. The frequency-domain noise shaping method of claim 1, wherein filtering the transform coefficients comprises filtering the transform coefficients prior to quantization of the transform coefficients producing the quantization noise, and inverse filtering the transform coefficients after quantization of said transform coefficients.

8. A frequency-domain noise shaping method for interpolating a spectral shape and a time-domain envelope of a quantization noise in a windowed and transform-coded audio signal, comprising:

splitting transform coefficients of the windowed and transform-coded audio signal into a plurality of spectral bands; and for each spectral band:

calculating a first gain representing, together with corresponding gains calculated for the other spectral bands, a spectral shape of the quantization noise at a first transition between a first time window and a second time window;

calculating a second gain representing, together with corresponding gains calculated for the other spectral bands, a spectral shape of the quantization noise at a second transition between the second time window and a third time window; and an operation of filtering the transform coefficients of the second time window, the filtering operation receiving as first input the transform coefficients of the second time window and as second input the first and second gains to filter said transform coefficients of the second time window using the second input, first and second gains to interpolate between the first and second transitions the spectral shape and the time-domain envelope of the quantization noise;

wherein filtering the transform coefficients comprises calculating filter parameters on the basis of the first and second calculated gains.

9. The frequency-domain noise shaping method of claim 1, further comprising, following filtering of the transform coefficients in each of the spectral bands:

quantizing the filtered transform coefficients;

encoding the quantized, filtered transform coefficients; and transmitting the encoded, quantized, filtered transform coefficients to a receiver or storing the encoded, quantized, filtered transform coefficients in a storage device.

10. The frequency-domain noise shaping method of claim 1, further comprising:

receiving from a transceiver or retrieving from a storage device filtered, quantized and encoded transform coefficients;

decoding the filtered, quantized and encoded transform coefficients; and inverse quantizing the decoded, filtered and quantized transform coefficients.

11. A frequency-domain noise shaping device for interpolating a spectral shape and a time-domain envelope of a quantization noise in a windowed and transform-coded audio signal having transform coefficients, comprising:

a processor comprising:

a splitter module configured to split the transform coefficients of the windowed and transform-coded audio signal into a plurality of spectral bands;

a calculator module configured to calculate, for each spectral band, a first gain representing, together with corresponding gains calculated for the other spectral bands, a spectral shape of the quantization noise at a first transition between a first time window and a second time window, and a second gain representing, together with corresponding gains calculated for the other spectral bands, a spectral shape of the quantization noise at a second transition between the second time window and a third time window; and a filter module configured to filter the transform coefficients of the second time window, the filter module receiving as first input the transform coefficients of the second time window and as second input the first and second gains to filter said transform coefficients of the second time window using the second input, first and second gains to interpolate between the first and second transitions the spectral shape and the time-domain envelope of the quantization noise.

12. A frequency-domain noise shaping device for interpolating a spectral shape and a time-domain envelope of a quantization noise in a windowed and transform-coded audio signal having transform coefficients, comprising:

a processor comprising:

a splitter module configured to split the transform coefficients of the windowed and transform-coded audio signal into a plurality of spectral bands;

a calculator module configured to calculate, for each spectral band, a first gain representing, together with corresponding gains calculated for the other spectral bands, a spectral shape of the quantization noise at a first transition between a first time window and a second time window, and a second gain representing, together with corresponding gains calculated for the other spectral bands, a spectral shape of the quantization noise at a second transition between the second time window and a third time window; and a filter module configured to filter the transform coefficients of the second time window, the filter module receiving as first input the transform coefficients of the second time window and as second input the first and second gains to filter said transform coefficients of the second time window using the second input, first and second gains to interpolate between the first and second transitions the spectral shape and the time-domain envelope of the quantization noise;

wherein the windowed and transform-coded audio signal is windowed using successive overlapping windows, and wherein the calculator module calculates the first gain at a middle point of an overlap between the first and second time windows, and the second gain at a middle point of an overlap between the second and third time window.

13. The frequency-domain noise shaping device of claim 11, wherein the gain calculator module applies a linear predictive coding to the windowed and transform-coded audio signal in order to calculate the first gain and the second gain.

14. A frequency-domain noise shaping device for interpolating a spectral shape and a time-domain envelope of a quantization noise in a windowed and transform-coded audio signal having transform coefficients, comprising:

a processor comprising:

a splitter module configured to split the transform coefficients of the windowed and transform-coded audio signal into a plurality of spectral bands;

a calculator module configured to calculate, for each spectral band, a first gain representing, together with corresponding gains calculated for the other spectral bands, a spectral shape of the quantization noise at a first transition between a first time window and a second time window, and a second gain representing, together with corresponding gains calculated for the other spectral bands, a spectral shape of the quantization noise at a second transition between the second time window and a third time window; and a filter module configured to filter the transform coefficients of the second time window, the filter module receiving as first input the transform coefficients of the second time window and as second input the first and second gains to filter said transform coefficients of the second time window using the second input, first and second gains to interpolate between the first and second transitions the spectral shape and the time-domain envelope of the quantization noise, wherein the transform coefficient filter module achieves a desired spectral shape of the quantization noise at the first and second transitions and a smooth transition of an envelope of this spectral shape from the first transition to the second transition.

15. The frequency-domain noise shaping device of claim 11, wherein the transform coefficient filter module filters the transform coefficients prior to quantization of the transform coefficients producing the quantization noise.

16. The frequency-domain noise shaping device of claim 11, wherein the transform coefficient filter module filters the transform coefficients after quantization of the transform coefficients producing the quantization noise.

17. The frequency-domain noise shaping device of claim 11, wherein the transform coefficient filter module filters the transform coefficients prior to quantization of the transform coefficients producing the quantization noise, and inverse filters the transform coefficients after quantization of said transform coefficients.

18. A frequency-domain noise shaping device for interpolating a spectral shape and a time-domain envelope of a quantization noise in a windowed and transform-coded audio signal having transform coefficients, comprising:

a processor comprising:

a splitter module configured to split the transform coefficients of the windowed and transform-coded audio signal into a plurality of spectral bands;

a calculator module configured to calculate, for each spectral band, a first gain representing, together with corresponding gains calculated for the other spectral bands, a spectral shape of the quantization noise at a first transition between a first time window and a second time window, and a second gain representing, together with corresponding gains calculated for the other spectral bands, a spectral shape of the quantization noise at a second transition between the second time window and a third time window; and a filter module configured to filter the transform coefficients of the second time window, the filter module receiving as first input the transform coefficients of the second time window and as second input the first and second gains to filter said transform coefficients of the second time window using the second input, first and second gains to interpolate between the first and second transitions the spectral shape and the time-domain envelope of the quantization noise, wherein the transform coefficient filter module calculates filter parameters on the basis of the first and second calculated gains.

19. The frequency-domain noise shaping device of claim 11 wherein, following filtering of the transform coefficients in each of the spectral bands, the processor:

quantizes the filtered transform coefficients;

encodes the quantized, filtered transform coefficients; and transmits the encoded, quantized, filtered transform coefficients to a transceiver or stores the encoded, quantized, filtered transform coefficients in a storage device.

20. The frequency-domain noise shaping device of claim 11, wherein the processor:

receives from a transceiver or retrieves from a storage device filtered, quantized and encoded transform coefficients;

decodes the filtered, quantized and encoded transform coefficients; and inverse quantizes the decoded, filtered and quantized transform coefficients.

21. An encoder for encoding a windowed audio signal, comprising:

a first coder of the windowed audio signal using a time-domain coding mode;

a second coder of the windowed audio signal using a transform-domain coding mode using a psychoacoustic model and producing a windowed and transform-coded audio signal;

a selector between the first coder using the time-domain coding mode and the second coder using the transform-domain coding mode when encoding a time window of the windowed audio signal; and a frequency-domain noise shaping device according to claim 11 for interpolating a spectral shape and a time-domain envelope of a quantization noise in the windowed and transform-coded audio signal, thereby achieving a desired spectral shape of the quantization noise at the first and second transitions and a smooth transition of an envelope of this spectral shape from the first transition to the second transition.

22. The encoder of claim 21, wherein the time-domain coding mode is ACELP and the transform-domain coding mode uses a MDCT.

23. The encoder of claim 21, wherein the frequency-domain noise shaping device uses, as the first and second gains, noise gains calculated from an LPC filter, scale factors calculated from the psychoacoustic model, or a combination of the noise gains and scale factors.

24. The encoder of claim 23, wherein the combination of the noise gains and scale factors comprises the sum of the noise gains and scale factors, where the scale factors are used as a correction to the noise gains.

25. The encoder of claim 21, wherein the frequency-domain noise shaping device uses, as the first and second gains, noise gains calculated from an LPC filter and a second set of gains or scale factors, used as a correction to the noise gains.

26. A decoder for decoding an encoded, windowed audio signal, comprising:

a first decoder of the encoded, windowed audio signal using a time-domain decoding mode;

a second decoder of the encoded, windowed audio signal using a transform-domain decoding mode using a psychoacoustic model; and a selector between the first decoder using the time-domain decoding mode and the second decoder using the transform-domain decoding mode when decoding a time window of the encoded, windowed audio signal; and a frequency-domain noise shaping device according to claim 11 for interpolating a spectral shape and a time-domain envelope of a quantization noise in transform-coded windows of the encoded, windowed audio signal, thereby achieving a desired spectral shape of the quantization noise at the first and second transitions and a smooth transition of an envelope of this spectral shape from the first transition to the second transition.

27. The decoder of claim 26, wherein the time-domain decoding mode is ACELP and the transform-domain decoding mode uses a MDCT.

28. The decoder of claim 26, wherein the frequency-domain noise shaping device uses, as the first and second gains, noise gains calculated from an LPC filter, scale factors calculated from the psychoacoustic model, or a combination of the noise gains and scale factors.

29. The decoder of claim 28, wherein the combination of noise gains and scale factors comprises the sum of the noise gains and scale factors, where the scale factors are used as a correction to the noise gains.

30. The decoder of claim 26, wherein the frequency-domain noise shaping device uses, as the first and second gains, noise gains calculated from an LPC filter and a second set of gains or scale factors, used as a correction to the noise gains.

31. The frequency-domain noise shaping device of claim 11 further comprising:

a storage device, wherein the processor is operably connected to the storage device for storing or retrieving the filtered transform coefficients.

32. The frequency-domain noise shaping device of claim 11 further comprising:

a transceiver, wherein the processor is operably connected to the transceiver for sending or receiving the filtered transform coefficients.

33. The frequency-domain noise shaping device of claim 12 further comprising:

a storage device, wherein the processor is operably connected to the storage device for storing or retrieving the filtered transform coefficients.

34. The frequency-domain noise shaping device of claim 12 further comprising:

a transceiver, wherein the processor is operably connected to the transceiver for sending or receiving the filtered transform coefficients.

35. The frequency-domain noise shaping device of claim 14 further comprising:

a storage device, wherein the processor is operably connected to the storage device for storing or retrieving the filtered transform coefficients.

36. The frequency-domain noise shaping device of claim 14 further comprising:

a transceiver, wherein the processor is operably connected to the transceiver for sending or receiving the filtered transform coefficients.

37. The frequency-domain noise shaping device of claim 18 further comprising:

a storage device, wherein the processor is operably connected to the storage device for storing or retrieving the filtered transform coefficients.

38. The frequency-domain noise shaping device of claim 18 further comprising:

a transceiver, wherein the processor is operably connected to the transceiver for sending or receiving the filtered transform coefficients.

* * * * *